United States Patent [19]

Hewitt

[11] Patent Number: 4,504,224

[45] Date of Patent: Mar. 12, 1985

[54] KILN FURNITURE

[76] Inventor: David K. Hewitt, Victoria Rd., Fenton, Stoke-on-Trent, England, ST4 2HR

[21] Appl. No.: 152,146

[22] Filed: May 22, 1980

[51] Int. Cl.[3] ..... F27D 5/00

[52] U.S. Cl. ..... 432/258; 432/259

[58] Field of Search ..... 432/258, 259

[56] References Cited

U.S. PATENT DOCUMENTS

| | | | |
|---|---|---|---|
| 971,228 | 9/1910 | Vance | 432/258 |
| 1,841,641 | 1/1932 | Schreiber | 432/259 |
| 1,969,126 | 8/1934 | Forse | 432/258 |
| 2,879,577 | 3/1959 | Milburn | 432/258 |
| 3,057,035 | 10/1962 | Layne | 432/259 |
| 3,992,139 | 11/1976 | Lovatt | 432/258 |
| 4,184,841 | 1/1980 | Robinson et al. | 432/258 |

FOREIGN PATENT DOCUMENTS

| | | | |
|---|---|---|---|
| 1022754 | 3/1953 | France | 432/258 |
| 680487 | 10/1952 | United Kingdom . | |
| 1047808 | 11/1966 | United Kingdom | 432/258 |

*Primary Examiner*—John J. Camby

*Attorney, Agent, or Firm*—Harpman & Harpman

[57] ABSTRACT

Kiln furniture for holding and supporting articles of refractory and ceramic flatware in spaced and stacked relationship during kiln firing has upper and lower end units detachably connected by pillars engaging apertures in said upper and lower end units. The points of contact and support between the pillars and the upper and lower end units are formed to prevent the build up of glaze spray and vapor between the engaging portions so as to prevent sticking and adherence of the portions while at the same time providing for a rapid and easy assembly and disassembly of the respective parts which permits repeated reuse of the kiln furniture.

8 Claims, 7 Drawing Figures

KILN FURNITURE

BACKGROUND OF THE INVENTION (1) Field of the Invention

This invention relates to kiln furniture and more particularly ceramic ware setters as used in positioning ceramic flatware in spaced and stacked relationship during kiln firing.

(2) Description of the Prior Art

Prior structures of this type may be seen in U.S. Pat. Nos. 971,228; 1,969,126; 3,057,035; 3,992,139 and 4,184,841.

The prior art patents show the progressive development of various caramic ware setters and kiln furniture and the immediate prior art is best demonstrated by the disclosure of U.S. Pat. No. 4,184,841 in which upper and lower triangular end units are bonded to a plurality of pillar assemblies to form a comparatively massive, rigid, unitary frame structure, portions of which are apertured and arranged to receive a plurality of vertically spaced section pins which in turn receive and hold the individual pieces of ceramic ware in spaced vertical relation to one another.

The prior art structures have the common undesirable feature of incorporating a relatively substantial mass of refractory material which must be heated in the kiln along with the ceramic ware being fired.

The present invention discloses a relatively lightweight, comparatively small mass ceramic ware setter in which suitable support for the ceramic ware is obtained and the construction is such that the various parts thereof may be continuously reused by being assembled and disassembled after each firing of ceramic ware thereon as will be understood by those skilled in the art.

SUMMARY OF THE INVENTION

A ceramic ware setter comprising a pair of V-shaped upper and lower end units spaced by three identically formed pillars having extensions on their opposite ends engaging apertures in the end units and a plurality of vertically spaced apertures in the pillars arranged to receive angularly positioned triangular section pins. The ends of the pillars are enlarged with respect to the extensions thereof and the apertures in which the extensions register so as to prevent the entrance of glaze spray and vapor and the resultant build up and sticking and adherence of the respective parts by reason thereof. The apertures are shaped to permit ready assembly and disassembly of the pillars from the end units by a rocking or tilting motion which progressively separates the surfaces of the end units, which receive the ends of the pillars and the surfaces of the ends and end extensions of the pillars so that breakage is avoided.

DESCRIPTION OF THE PREFERRED EMBODIMENT

Figure 1:
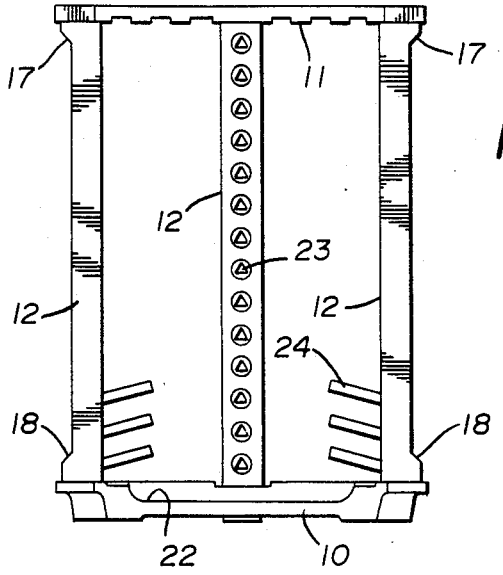
FIG. 1 is a plan view of the ceramic ware setter.
Figure 2:
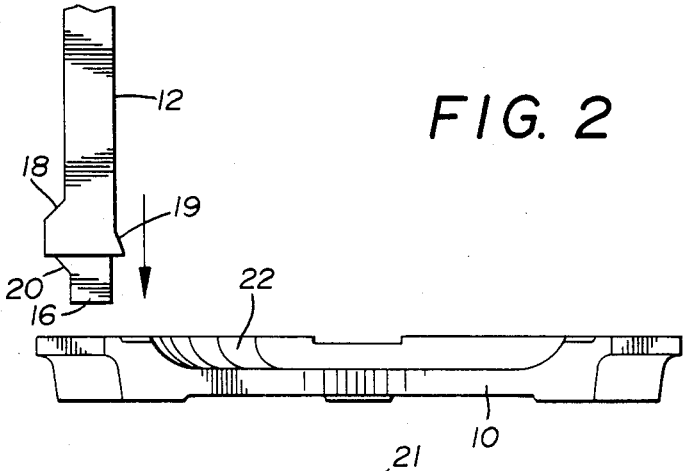
FIG. 2 is an enlarged plan view of one of the end units of the setter of FIG. 1 and a portion of one of the pillars of FIG. 1 in exploded relation.

In FIG. 1 of the drawings, the ceramic ware setter will be seen to comprise a lower end unit 10 and an upper end unit 11 spaced by three pillars 12. Both the lower end unit 10 and the upper end unit 11 are V-shaped in plan view and provided with apertures at their ends and apexes.

Figure 3:
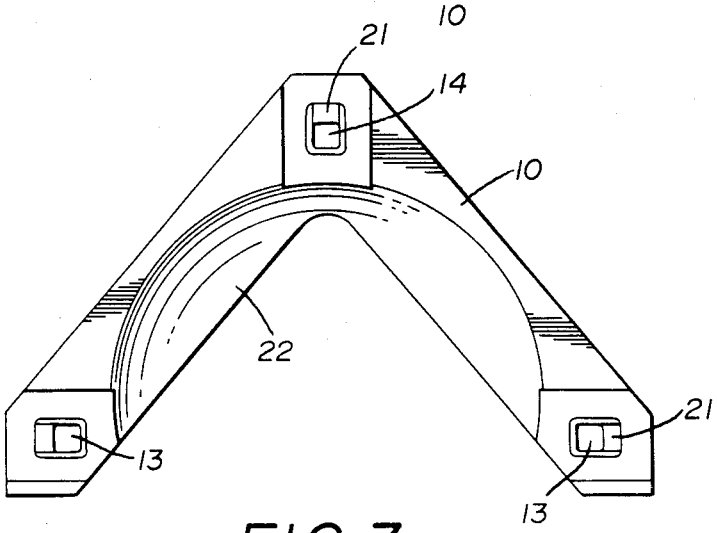
FIG. 3 is a top plan view of the end units of FIG. 1.
Figure 4:
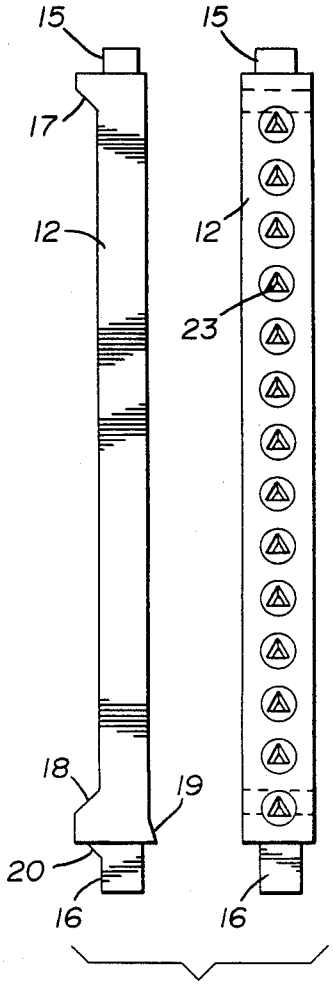
FIG. 4 is a composite view showing side and front views of one of the pillars of FIG. 1.

In FIG. 3 of the drawings the apertures at the ends are indicated by the numeral 13 and the aperture at the apex by the numeral 14. The upper ends of the pillars 12 are provided with relatively short extensions 15 as best seen in FIG. 4 of the drawings, and the lower ends of the pillars 12 are provided with relatively longer extensions 16.

Additionally, the upper ends of the pillars 12 are provided with shoulders 17 on the outer sides thereof and their lower ends are provided with oppositely disposed shoulders 18 and 19 respectively.

Figure 5:
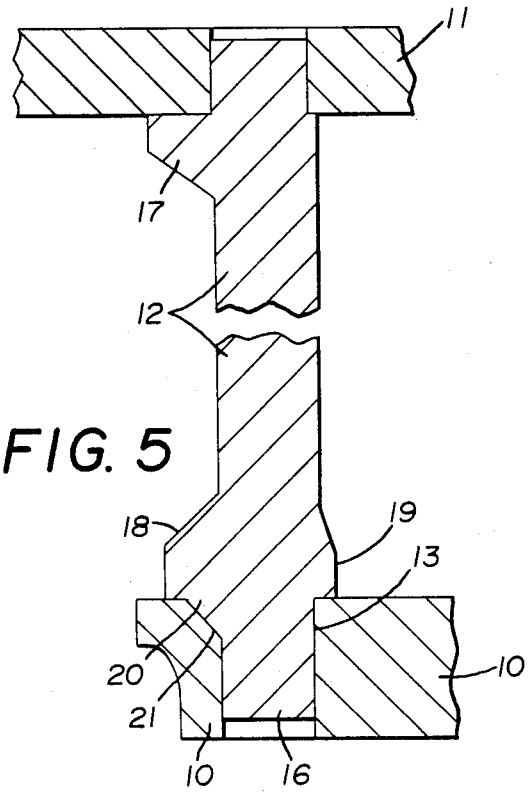
FIG. 5 is an enlarged cross sectional elevation of one of the pillars of FIG. 1 and portions of the end units engaged thereby.
Figure 7:
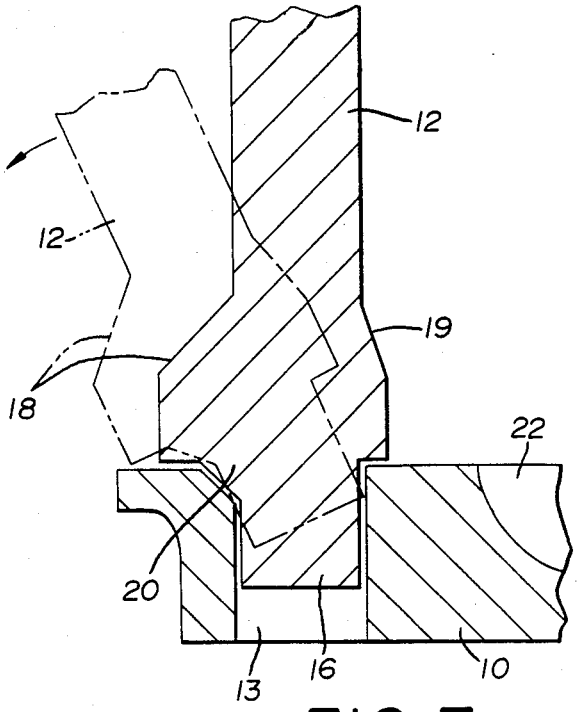
FIG. 7 is a vertical section on line 7—7 of FIG. 6 showing the addition of a portion of a pillar positioned in engagement therewith, broken lines in FIG. 7 show a disengaging movement of the pillar.
Figure 6:
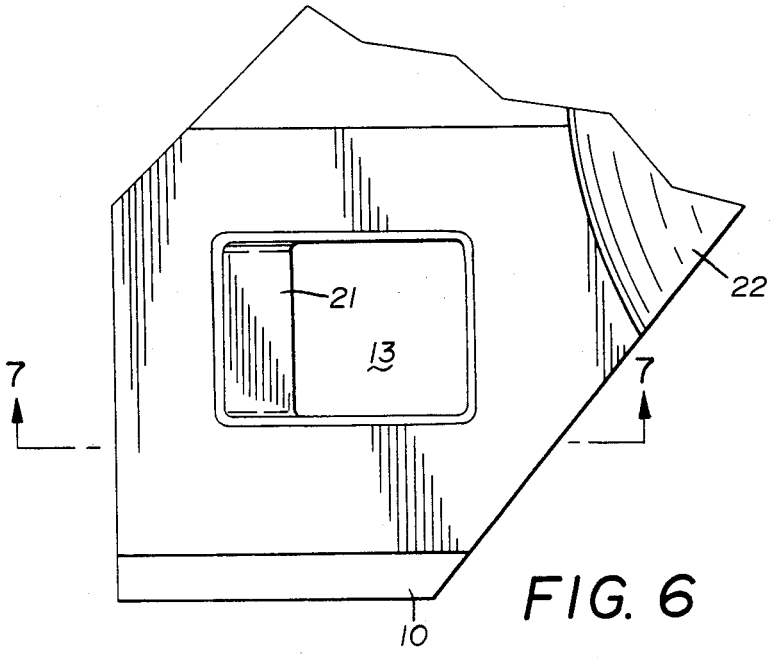
FIG. 6 is an enlarged plan view of a portion of one of the end units of FIG. 1.

The end extensions 16 are provided with secondary shoulders 20 arranged in oppositely disposed relation to the shoulders 18 thereabove and the apertures 13 and 14 in the lower end unit 10 in which the end extensions 16 register, have angularly disposed outward opening areas 21 which register with the secondary shoulders 20 on the extensions 16 of the pillars 12 as may best be seen by referring to FIGS. 5,6 and 7 of the drawings.

By referring again to FIG. 1 of the drawings, it will be seen that the upper end unit 11 is relatively thin and flat while the lower end unit 10 is of substantially greater thickness with the upper V-shaped surface thereof having an enlarged cavity configuration 22 formed therein as also seen in FIG. 3 of the drawings, so that the overall mass of ceramic of the lower end unit 10 is not substantially greater than the mass of the upper end unit 11.

By referring now to FIG. 1 of the drawings, it will be seen that each of the pillars 12 is provided with a series of uniformly vertically spaced openings 23 which are preferably triangular in cross section and disposed at an angle from horizontal and that a plurality of fitted laterally projecting replaceable section pins 24 are disposed therein. The section pins are directed generally towards a central axis to form a rack for the support of the ceramic ware stacked therein and it will be observed that only the outermost tips of the triangularly shaped pins 24 will engage the peripheral portions of the ceramic ware and thereby minimize the area of contact therewith which remains visible in the finished ceramic ware.

Those skilled in the art will understand that when the ceramic ware content has been fired in a kiln, the ceramic ware is removed and the setter disassembled so that the section pins 24 can then be replaced by new ones. In order to facilitate this replacement, which is usually done by machine, it is essential that the pillars to be readily separable from the upper and lower end units 10 and 11 and it is equally important that the engaged relationship of the pillars and the upper and lower end units be such that a rigid sturdy structure is formed which will permit several such structures to be stacked vertically without becoming unstable and collapsing.

Heretofore the glaze spray and vapor directed to the ceramic ware in the setter prior to firing the same in the kiln entered the areas between the pillars and the upper and lower end units and during firing in the kiln caused the adherence of these respective parts which then required breaking away upon dismantling and the frequent damaging of the ends of the pillars and/or the areas of the upper and lower end units adjacent the apertures therein which necessitated their replacement.

The present invention in addition to protecting the areas between the ends of the pillars and the surfaces of the upper and lower end units from glaze spray and vapor contamination provides that such contamination as does occur can be overcome to prevent the sticking and adherence which results from firing of the glaze on their respective surfaces concerned.

By referring to FIGS. 5, 6 and 7 of the drawings, it will be seen, as in FIG. 5, that when the upper and lower end units 11 and 10 respectively and the pillars 12 are assembled, a substantially rigid supporting structure is provided through the arrangement of the shoulders 17 and 18 on each of the pillars 12 respectively, which increase the area of support between the ends of the pillars 12 and the matching surfaces of the upper and lower end units 11 and 10 respectively.

More importantly, the shoulders 17 and 18, which are located on the outer sides of the pillars 12, that is away from the axial center of the setter formed by the device, enable the pillars to be tilted or rocked sidewardly in an arc which fulcrums on the outer lower portion of the shoulder 18 as seen in the broken line illustration in FIG. 7 of the drawings.

It will be observed that the configuration of the apertures 13 and 14 to include the angularly disposed outwardly opening areas 21 enables the adjacent portion of the extension 16 on each of the pillars 12 to move upwardly and outwardly of the apertures 13 and 14 when the pillars 12 are moved sidewardly as shown in FIG. 7 of the drawings.

It will occur to those skilled in the art that when such motion is applied to the pillars 12 as in disassembling the setter after firing and the removal of the ceramic ware therefrom, any glaze that has entered the areas between the pillars 12 and their extensions 16 and the surfaces of the apertures 13 and 14 and fused to form an attachment will be progressively broken away by the progressive separation of these surfaces by the tilting of the pillars 12 as heretofore described. The same configurations which contribute to the successful separation of the pillars from the end units enables a more ready assembly of these parts when the setter is reassembled for the reception of additional ceramic ware to be fired while supported thereby.

It will thus be seen that the kiln furniture described and disclosed herein incorporates two advantages which are not found in or suggested by the prior art and specifically the construction of the pillars relative to their extensions so that the area around the apertures in the end units is protected from glaze spray or vapor contamination and at the same time provides that when such contamination does occur, the parts may be progressively separated by the rocking action hereinbefore described, without damaging the pillars, their extensions, their shoulders or the end units or the surfaces thereof around and about the apertures therein.

The above and described structure provides relatively easy and fast assembly and disassembly of the filn furniture and insures that the respective parts thereof will not be damaged by such disassembly as has heretofore been frequently found in the prior art structures so that the respective parts of the ceramic ware setter can be used repeatedly thus considerably lowering the cost of the production of ceramic ware therewith.

Although but one embodiment of the present invention has been illustrated and described, it will be apparent to those skilled in the art that various changes and modifications may be made therein without departing from the spirit of the invention and having thus described my invention what I claim is:

1. Kiln furniture comprising:

a setter for holding and supporting articles of refractory or ceramic flatware in spaced and stacked relationship during kiln firing, said setter including an upper end unit having a plurality of apertures defined therein;

a lower end unit having a top surface and a plurality of second apertures defined therein, said second apertures including a lower section and an upper section, said upper section including a ramp means angled upwardly from said lower section and outwardly of said lower end unit, said upper and lower sections being equally sized except for said ramp means;

a plurality of elongate pillars for detachably connecting said end units together, each pillar including a body portion, a top end portion, a bottom end portion, a plurality of mounting means on said body portion to be spaced apart along said body portion for supporting articles when said setter is assembled, end extensions on said top and bottom ends, said top end extensions being sized and shaped to be snugly received in said upper end unit apertures and said bottom end extensions being sized and shaped to be loosely received in said aperture lower sections to define a gap, a first shoulder on said pillar bottom end portion and a second shoulder on said pillar bottom end portion, said second shoulder extending in a direction opposite to said first shoulder and extending outwardly from said pillar body a distance sufficient to cover said ramp means when said each pillar is mounted on said lower end unit, said each pillar further including a pivot ramp means connecting said second shoulder to said bottom end extension, said pivot ramp means being juxtaposed to said upper section ramp means when said each pillar is mounted on said lower end unit to cooperate with said upper section ramp means to define a tilting means for tilting said each pillar during removal of said each pillar from engagement with said lower end unit, said tilting means further including an outer edge of said second shoulder and said gap, said tilting means permitting progressive separation of said each pillar from said lower end unit whereby any glaze which may have hardened between said each pillar and said end unit in said second apertures can be progressively broken.

2. The kiln furniture set forth in claim 1 and wherein said upper and lower end units are V-shaped with said apertures located at the ends of the V-shapes and the apex thereof.

3. The kiln furniture set forth in claim 1 and wherein each end of each of said vertical pillars is of smaller cross sectional area than the remainder thereof so as to form an end extension beyond the shoulders on said pillars.

4. The kiln furniture set forth in claim 1 and wherein said second apertures in said lower end unit are cross sectionally square and define substantially planar walls, one of which in each aperture has said ramp means thereon to be outwardly and upwardly inclined to widen said aperture at its uppermost end.

5. The kiln furniture set forth in claim 1 further including a top shoulder on each of said pillar top end portions.

6. The kiln furniture set forth in claim 5 wherein the top shoulders have upwardly and outwardly inclined portions and planar upper surfaces and the first and second shoulders have downwardly and outwardly extending portions and planar lower surfaces, said planar surfaces engaging said end units.

7. The kiln furniture defined in claim 1 wherein said mounting means includes a plurality of openings defined in said each pillar body portion and a plurality of openings defined in said each pillar body portion and a plurality of support pins each having means for removably mounting said each pin in one of said plurality of openings defined in a pillar body for supporting an article thereon.

8. The kiln furniture defined in claim 7 wherein said mounting means is upwardly angularly disposed when said setter is assembled.

* * * * *